US006234179B1

(12) United States Patent
Alcaraz

(10) Patent No.: US 6,234,179 B1
(45) Date of Patent: May 22, 2001

(54) CIGAR OR CIGARETTE HOLDER FOR GOLF CART

(76) Inventor: Vicente Alcaraz, P.O. Box 191168, San Juan, PR (US) 00919-1168

( * ) Notice: Subject to any disclaimer, the term of this patent is extended or adjusted under 35 U.S.C. 154(b) by 0 days.

(21) Appl. No.: 09/441,288

(22) Filed: Nov. 16, 1999

Related U.S. Application Data

(63) Continuation-in-part of application No. 08/975,467, filed on Nov. 21, 1997, now abandoned.

(51) Int. Cl.[7] ..... A24F 13/22; A24F 9/14; A24F 13/02

(52) U.S. Cl. ..... 131/259; 131/257; 131/260; 131/187; 131/224; 131/178; D27/138

(58) Field of Search ..... 131/175, 257, 131/259, 260, 187, 188, 224, 178, 330, 329; D27/172, 183, 138

(56) References Cited

U.S. PATENT DOCUMENTS

| | | | | |
|---|---|---|---|---|
| D. 379,551 | * | 5/1997 | Hubbard | D27/183 |
| 4,838,285 | * | 6/1989 | Petrone | 131/259 |
| 5,588,448 | * | 12/1996 | Photakis | 131/259 |
| 5,909,735 | * | 6/1999 | Knudsen | 131/257 |

* cited by examiner

*Primary Examiner*—James Derrington
*Assistant Examiner*—Dianne A. Walls

(57) ABSTRACT

A cigar or cigarette holder that inserts into the spare-tee-holding-holes found in the plastic molded dashboards of most golf carts. It has a tapered-shaped-segment (12) that is pushed into said spare-tee-holding-holes until it is securely held. At a variable angle from said tapered end is the smoking article holding segment (10) that is designed so as to hold different sized smoking articles.

3 Claims, 3 Drawing Sheets

CIGAR OR CIGARETTE HOLDER FOR GOLF CART

CROSS REFERENCES TO RELATED APPLICATIONS

Continuing Application:

This patent is based upon an application which is a continuation-in-part of my application Ser. No. 08/975,467 filed Nov. 21, 1997 now abandoned.

BACKGROUND—FIELD OF INVENTION

This invention relates to a smoking article holder that inserts into one of the spare-tee-holding-holes found in the dash of most golf carts.

BACKGROUND—DESCRIPTION OF PRIOR ART

Smoking golfers often find themselves with a lighted cigar/cigarette and nowhere to place it when they are about to hit the golf ball. The golfer usually will lay the smoking article in the grass or balance it somewhere in the golf cart if he does not want to place it in the ground. Several smoking article holders to be used while playing golf have been devised but they have some drawbacks.

Petrone (U.S. Pat. No. 4,838,285), Photakis (U.S. Pat. No. 5,588,448), and Hasselgren (U.S. Pat. No. D380,862) described similar holders for smoking articles designed to be inserted vertically into the ground. This type of holder presents several disadvantages:

1) Due to their vertical oriented design they are not intended and cannot be inserted in the horizontally aligned said spare-tee-holding-hole since the smoking article will obviously fall.
2) Furthermore, they cannot be successfully modified to be used in the horizontal position by moving the tee-shaped segment 90-degrees since the standard golf tees are not tapered-shaped but consist of a uniform diameter straight segment with one pointed or sharp end and a flange head on the other. This uniform diameter of the tee-shaped segment does not produce enough friction in said spare-tee-holding-holes to eliminate its rotation by torsional forces allowing it to rotate on its axis and the smoking article to fall.
3) They are designed to be inserted in the ground and as such have to be inserted and removed after each and every shot the golfer makes.
4) Since they are inserted in the ground the golfer has to carry in his pocket a dirty object.

Knudsen (U.S. Pat. No. 5,909,735) describes a holder that is designed for the horizontally aligned golf-tee-holding-holes in the dash of most golf carts. He addresses the problem of the rotation of the holder in its axis allowing the smoking article to fall by incorporating a "clamp" to hold the smoking article. Some disadvantages of his holder include:

1) The smoking article has to be of an specific size for it to be held in place by said "clamp". Since smoking articles come in very different sizes the smoker would have to obtain multiple holders of different sizes and even that will not guarantee that any particular size article will be adequately clamped. Smaller sized articles cannot be clamped and will fall, larger sized articles will be crushed by the clamp and/or unrolled, something that the fine-cigar smoker dislikes.
2) Although his design allows for the holder to be inserted into the horizontally aligned holes which are found in most golf carts. It does not provide for it to be used in the vertically aligned holes still found in some models of golf carts.
3) The smooth pin that is described tends to loosen inside the retaining hole, allowing the holder to rotate on its axis.

SUMMARY INCLUDING OBJECTS AND ADVANTAGES

A smoking article holder specially designed to be inserted into the spare-tee-holding holes found in the molded plastic dashboards of most golf carts. It provides the golfer a holder to place his cigar/cigarette while he/she executes the golf shot. Its design allows for it to be inserted into horizontally as well as vertically placed tee-holding-holes. In its preferred embodiment the segment that inserts into said spare-tee-holding hole is made of moldable plastic so that it deforms when pushed into said hole providing for a secure hold. The smoking article holding segment is designed so as to be able to accommodate smoking articles of very different sizes.

Objects and Advantages

Accordingly, the main object and advantage of my invention is to eliminate the disadvantages described in the previous inventions and to provide the smoking golfer with:

1) An inexpensive smoking article holder with a 90-degree rotating, tapered-shaped-segment that allows it to be inserted firmly and securely into either the vertically or horizontally oriented tee-holding-holes found in the dash of golf carts.
2) Allows him to insert smoking objects of different sizes without having to buy a different holder to fit each different size smoking article.
3) Its innovative vertical holding position of the larger sized smoking articles decreases their torsional effect on the tapered-shaped-segment that inserts into said spare-tee-holding-holes minimizing its tendency to twist on its axis.
4) The moldable plastic design of the tapered segment deforms with pressure further increasing its hold inside the spare-tee holding-hole and decreasing any twisting possibility.

REFERENCE NUMERALS

Figure 1:
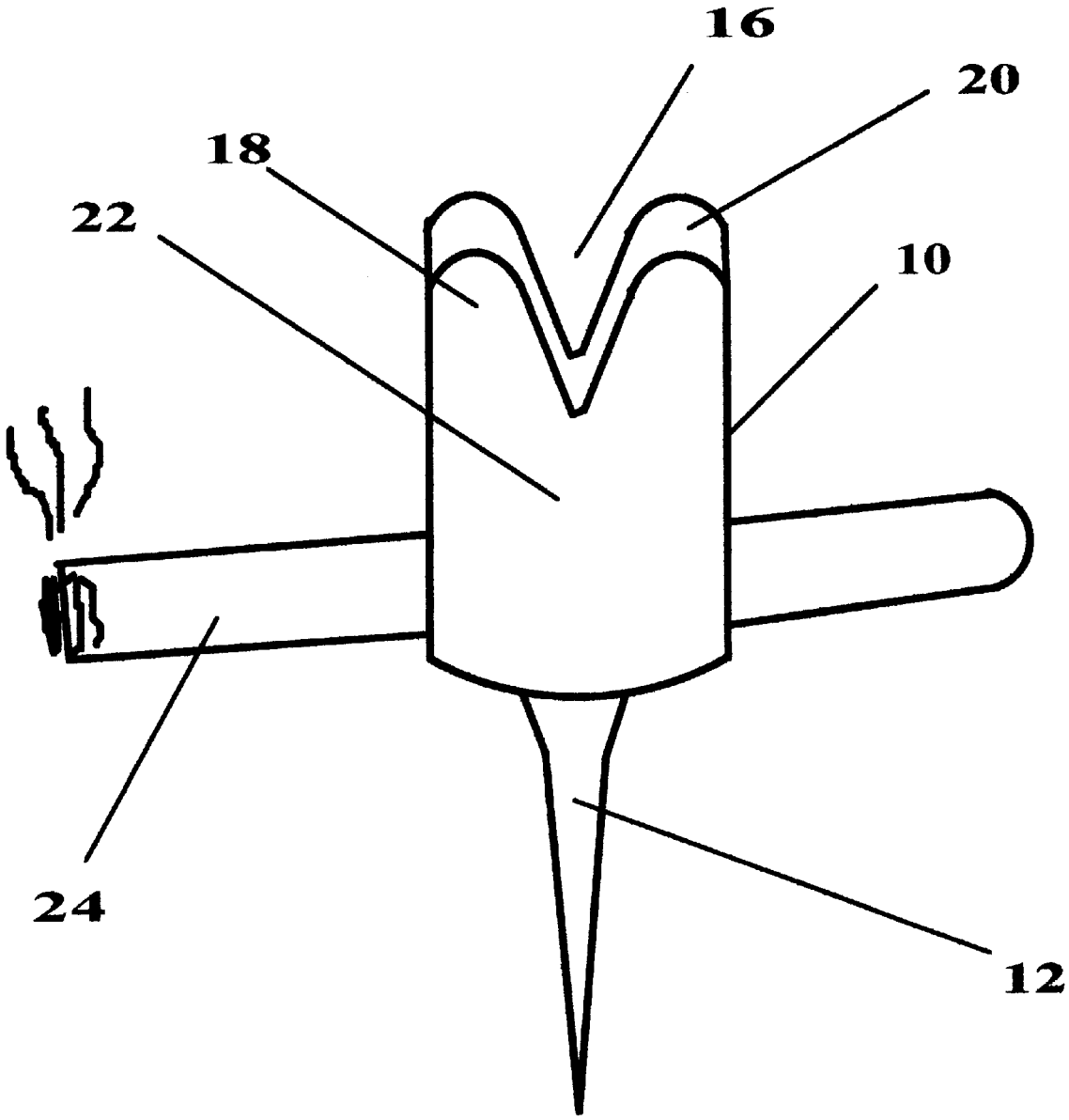
FIG. 1 is a frontal view of my smoking article holder. It is shown with the tapered-shaped-segment 12 in its vertical position. For illustration purposes it shows the frontal view while holding a medium-size cigar.

10 smoking article holding segment
12 tapered-shaped-segment
14 space formed between the two vertical arms of the holder
16 V or U-shaped notches
18 frontal section
20 posterior section
22 front surface
24 medium-size cigar
26 large-size cigars
28 small-size cigars or cigarettes.

Summary Including Objects and Advantages

A smoking article holder specially designed to be inserted into the spare-tee-holding holes found in the molded plastic dashboards of most golf carts. It provides the golfer a holder to place his cigar/cigarette while he/she executes a shot. Its design allows for it to be inserted into horizontally as well as vertically placed holes. In its preferred embodiment the segment that inserts into said spare-tee-holding holes is made of moldable plastic so that it deforms when pushed into said holes providing for a more secure hold. The smoking article holding segment is so designed so as to be able to accommodate smoking article of very different sizes.

Preferred Embodiment—Description

Figure 2:
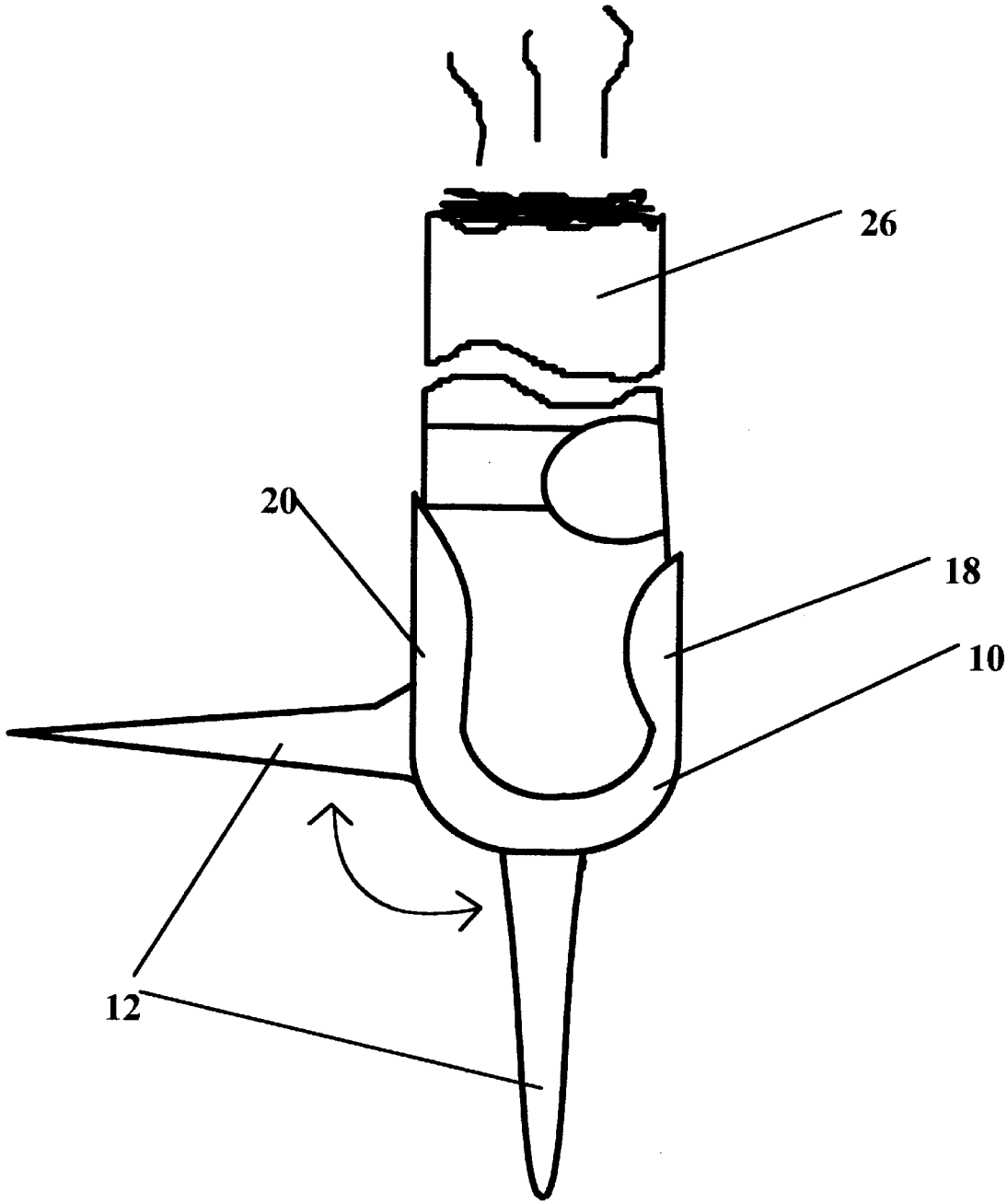
FIG. 2 is a is a side view illustrating the vertical holding of a large diameter cigar as well as the 90-degree rotation of the tapered-shaped-segment 12 to allow for horizontal or vertical positioning of the holder.
Figure 3:
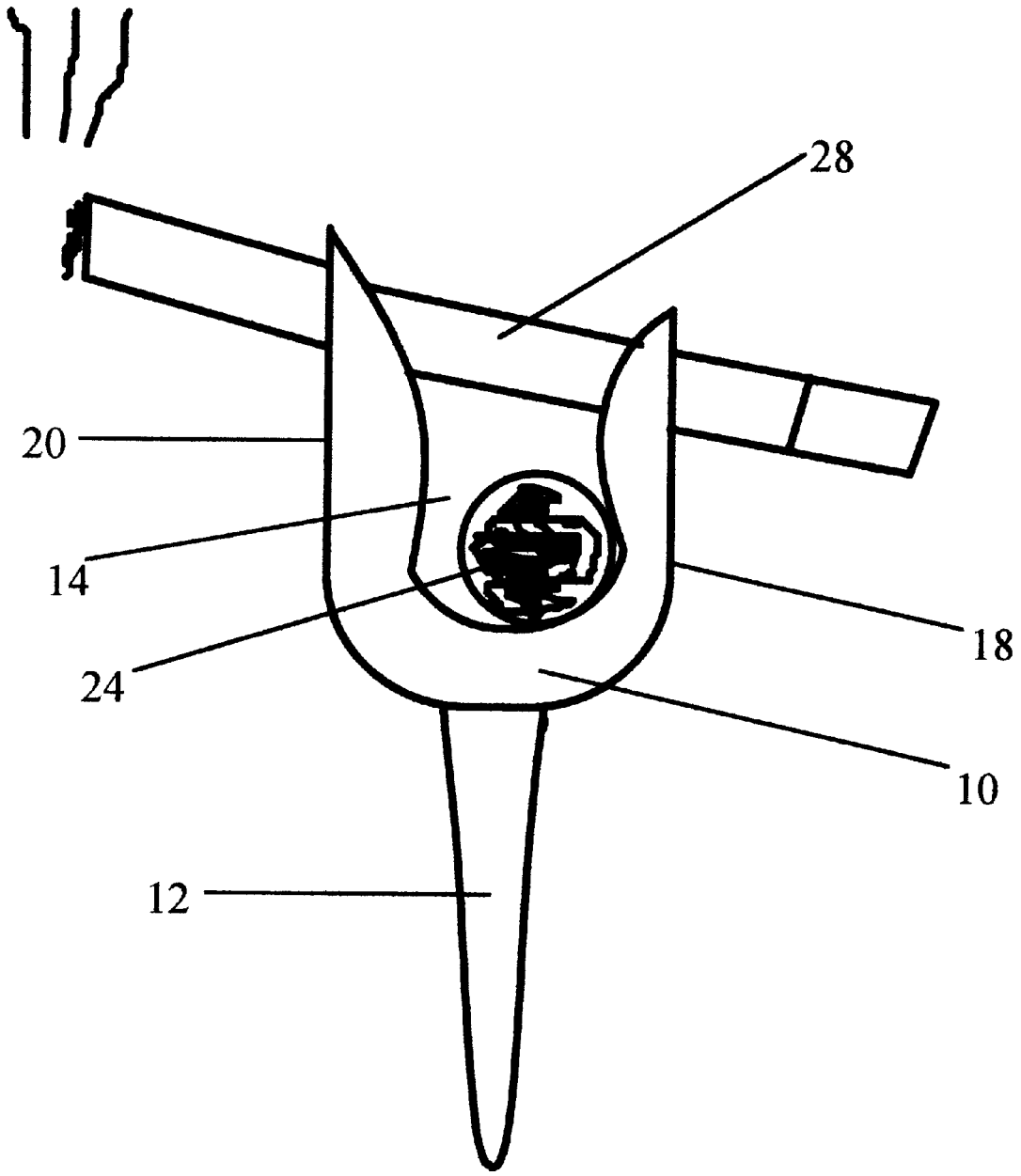
FIG. 3 is a is also a side view of the cigar holder. For illustration purposes it is shown while holding a small cigar and/or cigarette and a medium-size cigar.

FIG. 1 shows the frontal view of the smoking article holder. The holder consists basically of two segments: a smoking article holding segment 10 plus a tapered-shaped-segment 12 that inserts into the spare-tee-holding-holes found in golf carts. Said smoking article holder can be of any suitable material but in the preferred embodiment the holding segment 10 is of non-flammable plastic and the tapered-shaped-segment 12 is made of moldable, deformable plastic. The uniquely designed shape of said smoking-article-holding segment 10 allows for the smoking article to be held in any of three different places to accommodate for the different smoking article sizes. FIG. 1 also demonstrates how a medium-size cigar 24 is held in the space formed between the two vertical arms of the holder 14. Also illustrated are the V or U-shaped notches 16 in the superior border of the frontal section 18 and posterior section 20 of the holder designed for holding small-size cigars or cigarettes 28. The holder presents a smooth front surface 22 adequate for placing advertisements, information or instructions. FIG. 2 illustrates the 90-degree movement of said tapered-shaped-segment 12 as well as the innovative vertical holding of large-size cigars 26. The posterior section 20 of the smoking article holding segment 10 is designed to be slightly longer than its frontal section 18 for easier insertion of the cigar. FIG. 3 is also a side view demonstrating how small and medium size articles are held.

Preferred Embodiment—Operation

Operation of the smoking article holder is simple. Insert the tapered-shaped-segment 12 into one of the holes provided to store spare tees in most golf carts. Said tapered-shaped-segment 12 is rotated so as to be 90-degrees from the smoking article holding segment 10 if the cart comes supplied with horizontal tee-holding-holes or 180-degrees, if they are vertical. Push the holder in until the moldable plastic of the tapered-shaped-segment 12 deforms and securely locks the holder in place to avoid twisting. The smoking article then can be held in any of the three previously described places according to their size.

Conclusions, Ramifications, and Scope

Accordingly, it can be seen that the design provides for an inexpensive smoking article holder to be used in golf carts while the golfer plays his/her golf shot. Its rotating tapered-shaped-segment 12 specifically provides for it to be inserted in any position from 90–180 degrees as well as for a secure hold into the tee-holding-hole so as to prevent twisting. The design of the smoking article holding segment 10 provides three different spaces to accommodate different sized smoking articles. Although the description above contains many specificities, these should not be construed as limiting the scope of the invention but as merely providing illustrations of the presently preferred embodiment of this invention. Various other embodiments and ramifications are possible within it's scope. For example, it can be made of more expensive materials if a more durable holder is desired.

Thus the scope of the invention should be determined by the appended claims and their legal equivalents, rather than by the examples given.

What is claimed is:

1. A golf cart smoking article holder comprising:

a) a smoking article holding segment having an upper surface for supporting the smoking article, and a lower surface; and b) a tapered-shaped segment extending from the lower surface of said holding segment, wherein said tapered-shaped segment is capable of rotating 90 degrees so as to allow for the holder to be inserted into vertically or horizontally oriented tee-holding holes.

2. A smoking article holder as recited in claim 1 in which said tapered-shaped-segment is made of moldable plastic so as to deform and securely hold when pushed into the tee-holding holes found in golf carts.

3. A smoking article holder as recited in claim 1 in which said smoking article holding segment is designed so as to hold multiple sized smoking articles.

* * * * *